US009865955B2

(12) United States Patent
Joo et al.

(10) Patent No.: US 9,865,955 B2
(45) Date of Patent: Jan. 9, 2018

(54) ACCESS TERMINAL FOR CARD SOCKET

(71) Applicant: Molex, LLC, Lisle, IL (US)

(72) Inventors: Sung Hyuk Joo, Ansan (KR); In Chull Yang, Ansan (KR)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/314,832

(22) PCT Filed: Jun. 17, 2015

(86) PCT No.: PCT/KR2015/006122
§ 371 (c)(1),
(2) Date: Nov. 29, 2016

(87) PCT Pub. No.: WO2015/194845
PCT Pub. Date: Dec. 23, 2015

(65) Prior Publication Data

US 2017/0194732 A1 Jul. 6, 2017

(30) Foreign Application Priority Data

Jun. 17, 2014 (KR) ..... 10-2014-0073663

(51) Int. Cl.
*H01R 4/48* (2006.01)
*H01R 13/24* (2006.01)
(Continued)

(52) U.S. Cl.
CPC ..... *H01R 13/2457* (2013.01); *H01R 12/71* (2013.01); *H01R 13/14* (2013.01)

(58) Field of Classification Search
CPC .. H01R 13/2457; H01R 12/716; H01R 12/71; H01R 13/14; H01R 12/721
(Continued)

(56) References Cited

U.S. PATENT DOCUMENTS 7,628,655 B1 * 12/2009 Chen ..... H01R 12/721 439/60
9,236,678 B2 1/2016 Joo et al.
(Continued)

FOREIGN PATENT DOCUMENTS

JP 2002-100440 A 4/2002
JP 2007-324007 A 12/2007
(Continued)

*Primary Examiner* — Jean F Duverne
(74) *Attorney, Agent, or Firm* — James A. O'Malley

(57) ABSTRACT

The present disclosure relates to an access terminal for a card socket provided to an electronic device such as a mobile communication terminal and, more specifically, to an access terminal for a card socket capable of multi-accessing one card terminal provided to a card. The access terminal for a card socket, of the present disclosure, provided in a housing of the card socket for an electronic device so as to access a card containing various pieces of information or data includes a main terminal, an auxiliary terminal, and a connection unit for connecting the main terminal and the auxiliary terminal. The main terminal is provided in numbers corresponding to the numbers of card terminals of the card so as to access the card terminals. The auxiliary terminal is connected to the main terminal and selectively accesses the same card terminal accessed by the main terminal.

17 Claims, 7 Drawing Sheets

(51) Int. Cl.
*H01R 12/71* (2011.01)
*H01R 13/14* (2006.01)

(58) Field of Classification Search
USPC ..... 439/862
See application file for complete search history.

(56) References Cited

U.S. PATENT DOCUMENTS

| | | | | |
|---|---|---|---|---|
| 2010/0167590 | A1* | 7/2010 | Iwasaki | H01R 43/20 439/626 |
| 2010/0265389 | A1 | 10/2010 | Mizumura | |
| 2011/0070759 | A1* | 3/2011 | Matsumoto | G06K 7/0047 439/159 |
| 2011/0104920 | A1* | 5/2011 | Matsunaga | H01R 12/716 439/152 |
| 2015/0050840 | A1 | 2/2015 | Tsuji et al. | |

FOREIGN PATENT DOCUMENTS

| | | | |
|---|---|---|---|
| JP | 2011-060731 | A | 3/2011 |
| JP | 2013-077544 | A | 4/2013 |
| JP | 3186809 | U | 10/2013 |
| JP | 5488876 | B2 | 5/2014 |
| KR | 10-1146838 | B1 | 5/2012 |

* cited by examiner

ACCESS TERMINAL FOR CARD SOCKET

RELATED APPLICATIONS

This application is a national stage of International Application No. PCT/KR2015/006122, filed Jun. 17, 2015, which claims priority to Korean Application No. 10-2014-0073663, filed Jun. 17, 2014, both of which are incorporated herein by reference in their entirety.

TECHNICAL FIELD

This disclosure relates to an access terminal for a card socket furnished on an electronic apparatus such as a mobile telephony terminal. More specifically, this disclosure relates to an access terminal for a card socket that enables multiple access to a single card terminal.

BACKGROUND ART

Among the various cards furnished on a mobile telephony terminal, SIM cards are loaded with the majority of information needed for actuating the terminal; in particular, they are loaded with subscriber personal information such as passwords, as well as related encrypted data including the telephone number, network number, etc. Accordingly, mobile terminal are furnished with a SIM card socket in the main circuit board that is mounted within the terminal, and are designed so that the SIM card makes electrical contact with the SIM card socket.

In the SIM card socket is furnished a access terminal where contact occurs with the card terminal furnished on the SIM card. The card terminal and the access terminal of the socket correspond one-to-one; as in Korean Registered Patent No. 0919948 (hereinafter "the reference"), a single access terminal is contacted to a single card terminal.

According to the reference, in the housing there are furnished the same number of access terminals as are furnished on the SIM card; the contact point part of the access terminal protrudes up from the bottom surface of the housing to contact with the card terminal of the SIM card.

If the same number of access terminals are furnished on the SIM card socket as on the card terminal furnished on the SIM card, as in the prior patent, if some access terminals furnished on the SIM card socket are damaged then the signals cannot be properly transmitted, leading unavoidably to a product defect.

Patent Reference 1: Republic of Korea Registered Patent Gazette No. 0919948 (issued 2009 Oct. 1).

SUMMARY

The disclosure resolves the foregoing problems of the prior art and provides an access terminal for a card socket that can reliably make contact with the card terminal, by virtue of having a plurality of contact points that can make a plurality of contacts with a single card terminal furnished on the card.

The access terminal for a card socket of this disclosure is an access terminal that is furnished on the housing of a card socket of an electronic apparatus so as to make contact with a card that holds various data for information; it comprises main terminals that are furnished in a number corresponding to the card terminals furnished on the card so as to make contact with the card terminal; auxiliary terminals that optionally contact the same card terminal the main terminal contacts and the main terminal; and a connecting part that connects the main terminals and auxiliary terminals.

The main terminals and auxiliary terminals have different lengths.

On the connecting part, an elasticity reinforcement hole is formed to facilitate elastic deformation of the main and auxiliary terminals without plastic deformation.

The main terminals and auxiliary terminals extend as a single unit forward from the connecting part; the elasticity reinforcement hole is formed obliquely to the left or right of the center of the connecting part, so that the distance to one edge from the center line L, which passes through the center of the elasticity reinforcement hole from front to back, is less than the width measured from the center line L to the edge of the other side.

The portions of the connecting part to the left and right of the elasticity reinforcement hole become narrower toward the front.

The elasticity reinforcement hole grows wider toward the front of the connecting part.

One side of the portions of the connecting part to the left and right of the elasticity reinforcement hole, which has a lesser width measured from the center line L of the elasticity reinforcement hole, is located behind the one of the main and auxiliary terminals that is longer; the other side that has a greater width measured from the center line of the elasticity reinforcement hole is located behind the one of the main and auxiliary terminals that is shorter.

The width of the terminal, from among the main and auxiliary terminals, that is shorter is less than the width of the terminal that is longer.

When the card or card adapter is removed or inserted, as the auxiliary terminal first contacts the card or card adapter and descends, the auxiliary terminal also induces the main terminal, which is connected to it via the connecting part, to descend.

The main terminal and access terminal comprise: an upward-inclined part having internal elasticity, extending from the connecting part and formed sloping obliquely toward the front end; and a downward-inclined part extending inclined obliquely downward from the front end of the upward-inclined part.

The main and auxiliary terminals differ in length and in the height of the contact points.

The contact point of the main terminal and the contact point of the auxiliary terminal are formed at different positions front-to-back.

The auxiliary terminal is formed longer than the main terminal; the front end thereof is positioned lower than the front end of the main terminal on the housing.

When mounted in the housing, the front end of the auxiliary terminal is positioned lower than the internal floor of the housing.

The main and auxiliary terminals are formed separately from one another from the center of the front end of the connecting part.

The main terminal is formed with a shape that narrows to left and right from the part that connects to the connecting part to the part preceding the contact point.

The access terminal for a card socket according to this disclosure has the following effects.

First, because a plurality of contact points with the card terminal are formed due to the access terminal corresponding to each card terminal furnished on the SIM card being divided into a main terminal and auxiliary terminal, even if the contact status is defective due e.g. to the main terminal being damaged, a defective connection between the access terminal and card terminal can be prevented due to the auxiliary terminal also being contact to the card terminal, thus enabling product reliability to be maintained.

Second, plastic deformation of the access terminal may be prevented, and as a result product quality may be maintained over the long term, due to elastic deformation being facilitated when a SIM card is inserted into or removed from the card socket, due to the main and auxiliary terminals being formed with different lengths and widths, forming an elasticity reinforcement hole on the connecting part.

Third, the insertion or removal of the card or card adapter may be facilitated, without catching on the terminal, because when the card or card adapter is removed or inserted, as the auxiliary terminal first contacts the card or card adapter and descends, the auxiliary terminal also induces the main terminal, which is connected to it via the connecting part, to descend.

DETAILED DESCRIPTION OF THE PREFERRED EMBODIMENTS

Hereinbelow, access terminals for card sockets according to preferred embodiments of this disclosure will be explained in detail with reference to the attached diagrams.

Figure 1:
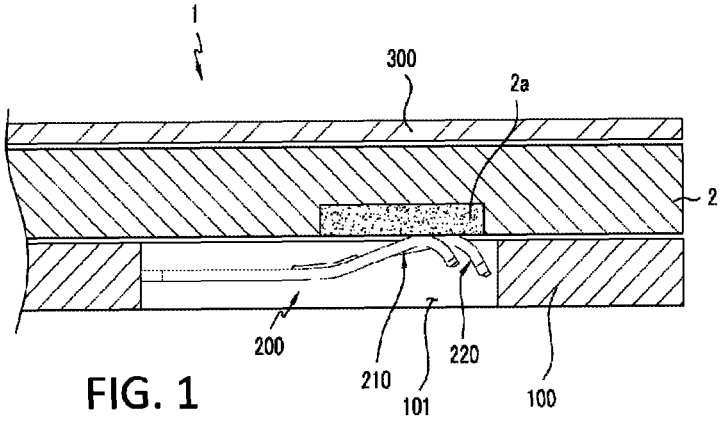
FIG. 1 is a drawing showing schematically the state in which a SIM card is inserted into a card socket using the access terminal for a card socket according to Embodiment 1 of this disclosure.

FIG. 1 is a drawing showing schematically the state in which a SIM card is inserted into a card socket using the access terminal for a card socket according to Embodiment 1 of this disclosure.

The card socket 1 comprises a housing 100, access terminal 200, and metal shell 300.

In the housing 100 is formed a terminal deformation hole 101 to enable elastic deformation when the access terminal 200 is depressed by the SIM card 2 when the SIM card 2 is inserted.

The rear end of the access terminal 200 is embedded in the housing 100; the front end is exposed via the terminal deformation hole 101 of the housing 100 so as to contact the card terminal 2*a* of the SIM card 2. The access terminal 200 comprises: a main terminal 210 that contacts the card terminal 2*a*, furnished in a number corresponding to the number of card terminals 2*a* furnished on the SIM card 2; and an auxiliary terminal 220 connected to the main terminal 210 so that the connection with the card terminal 2*a* can be maintained even if the main terminal 210 is damaged.

As shown in the drawing, because the main terminal 210 and auxiliary terminal 220 make contact with the same card terminal 2*a* at the same time, the auxiliary terminal 220 maintains its connection with the card terminal 2*a* even if the main terminal 210 is damaged (and also maintaining the connection of the main terminal and card terminal even if the auxiliary terminal is damaged); however, configurations are not limited thereto, and it may also be configured so that only the main terminal 210 is contacted with the card terminal 2*a* and the auxiliary terminal 220 contacts the card terminal 2*a* only if the main terminal 210 is damaged. In addition, it is possible for the main terminals 210 and auxiliary terminal 220 to contact the card terminal 2*a* simultaneously, or for the main terminal 210 alone to make contact, depending on factors such as the difference in thickness of the inserted card.

The contact point of the main terminal 210 and the contact point of the auxiliary terminal 220 are both located on top of the internal floor of the housing 100 so that they can make contact with the card terminal 2*a* before the SIM card 2 has been inserted.

Figure 2:
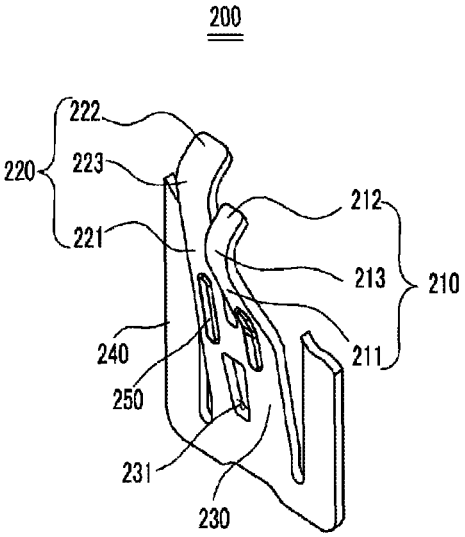
FIG. 2 is an oblique view of the card socket access terminal according to Embodiment 1 of this disclosure.
Figure 3:
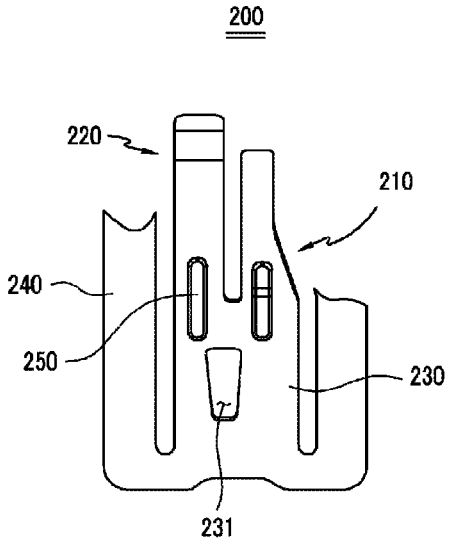
FIG. 3 is a top view of FIG. 2.
Figure 4:
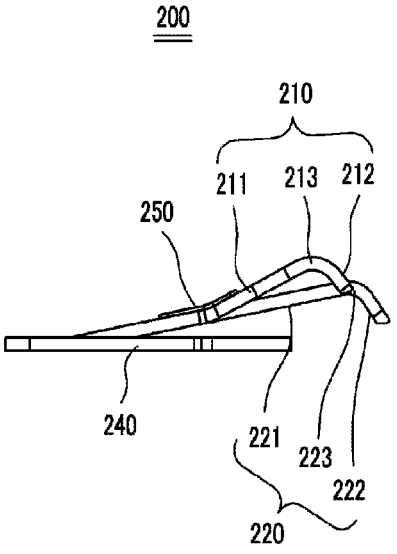
FIG. 4 is a front view of FIG. 2.

FIG. 2 is an oblique view of the card socket access terminal according to Embodiment 1 of this disclosure; FIG. 3 is a top view of FIG. 2, and FIG. 4 is a front view of FIG. 2.

The access terminal 200 according to this embodiment comprises: a main terminal 210, an auxiliary terminal 220, a connecting part 230, and an embedding part 240.

The main terminal 210 comprises: a first upward inclined part 211 that has internal elasticity due to being formed inclined upward obliquely toward the front end; a first downward-inclined part 212 extending inclined obliquely downward from the front end of the first upward-inclined part 211; and a first contact point 213 that is formed at the top end of the first upward-inclined part 211 so as to contact the card terminal 2*a*. The first upward-inclined part 211 is not formed in a straight line, and is formed in a single upward curve to afford greater elasticity.

The auxiliary terminal 220 comprises: a second upward inclined part 221 that has internal elasticity due to being formed inclined upward obliquely toward the front end; a second downward-inclined part 222 extending inclined obliquely downward from the front end of the second upward-inclined part 221; and a second contact point 223 that is formed at the top end of the second upward-inclined part 221 so as to contact the card terminal 2*a*.

The connecting part 230 connects the rear parts of the main terminal 210 and auxiliary terminal 220, so that the main terminal 210 and auxiliary terminal 220 are bifurcated from the center of the front end of the connecting part 230. On the connecting part 230, an elasticity reinforcement hole 231 is formed to increase the elasticity of the main terminal 210 and auxiliary terminal 220. When the main terminal 210 and auxiliary terminal 220 are deformed, due to this elasticity reinforcement hole 231 they will be smoothly elastically deformed rather than plastically deformed.

The embedded part 240 extends from the rear of the connecting part 230 toward either side of the main terminal 210 and auxiliary terminal 220, so that if the housing 100 and access terminal 200 are overmolded, the embedded part is embedded and fixed in place in the housing 100.

The second contact point 223 of the auxiliary terminal 220 is located in front of the first contact point 213 of the main terminal 210; its height is lower than that of the first contact point 213. In addition, the auxiliary terminal 220 is formed longer than the main terminal 210; the front end of the auxiliary terminal 220 is located below the front end of the main terminal 210.

Reference numeral 250 is a reinforcing bead that is formed across the connecting part 230 and each terminal 210, 220 so as to reinforce the contact pressure of the respective terminal 210, 220.

Figure 5:
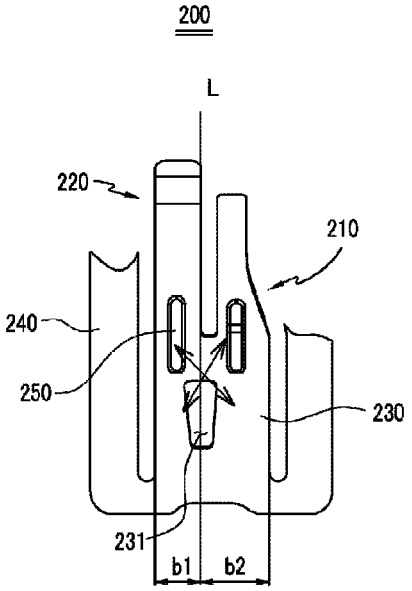
FIG. 5 illustrates the relationship between the width of the respective terminals and widths of either side of the connecting part in FIG. 3, using arrows.
Figure 6A:
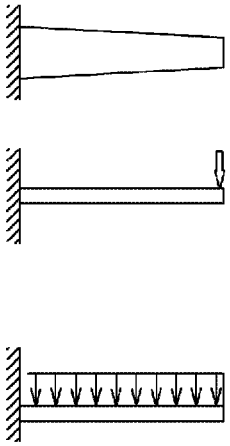
FIGS. 6A and 6B are stress distribution diagrams of a trapezoidal beam and a rectangular beam, respectively.
Figure 6B:
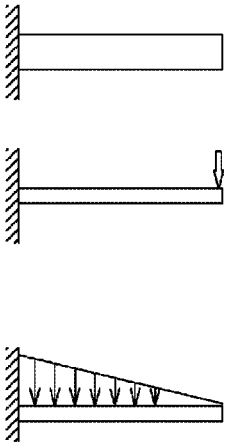

FIG. 5 illustrates the relationship between the width of the respective terminals and widths of either side of the connecting part in FIG. 3, using arrows; FIGS. 6A and 6B are stress distribution diagrams of a trapezoidal beam and a rectangular beam, respectively.

The length of the main terminal 210 is less than that of the auxiliary terminal 220 and the width is less than that of the auxiliary terminal 220, so that the contact pressure of the two terminals 210, 220 may be kept the same or similar. By minimizing the difference in contact pressure of the two terminals 210, 220, the difference in contact resistance (ah electrical feature) of the two terminals 210, 220 may be minimized.

As shown in Mathematical Formula 1 below (cantilever sagging formula), load F applied to the beam (referred to as the contact pressure at the contact terminal) is inversely proportional to the cube root of the length L, and is proportional to the width b of the beam.

$$\delta = FL^3/3EI = 4FL^3/Ebt^3 \qquad \text{Mathematical Formula 1 [Formula 1]}$$

(δ: sagging of beam, F: load applied to beam, L: length of beam, E: modulus of elasticity of ordinary structural steel, I: 2nd moment of cross-sectional area, b: width of beam, t: height of beam)

Based on Formula 1 above, by varying the lengths of the two terminals 210, 220 and forming them with different widths, they may be given a similar or identical contact pressure. Note that the terminal contact pressure removes impurities or oxide films formed on the contact part of the terminal, and plays an important role in facilitating the conduction of electricity. If the contact pressure is lower than required, then even if there is physical contact, electricity will not flow or the contact resistance will be increased so that there is an unnecessarily great risk of heat (or fire).

An elasticity reinforcement hole 231 is formed on the connecting part 230 in order to increase the elasticity of the terminals 210, 220; because the elasticity reinforcement hole 231 is reduced in left-right width from the rear toward the front end of each terminal 210, 220, the left-right width of the part located on the left or right side of the elasticity reinforcement hole 231 is also reduced toward the front end of the respective terminal 210, 220. The portions of the connecting part 230 formed on the left and right of the elasticity reinforcement hole 231 are formed trapezoidally, reducing in width towards the front end of the terminals 210, 220.

Note that as shown in FIG. 6A, when viewed from above, a beam having a trapezoidal shape will have an overall uniform stress distribution, while as shown in FIG. 6B, when viewed from above, a beam having a rectangular shape will have a non-uniform stress distribution.

As can be seen from these stress distribution diagrams, in Embodiment 1 of this disclosure, because the stress is uniformly distributed overall in the left and right parts of the connecting part 230, the risk of plastic deformation may be eliminated.

Additionally, because the elasticity reinforcement hole 231 is formed obliquely to one side of the connecting part 230, the width b1 from the center line L that passes through the center of elasticity reinforcement hole 231 to one side of the connecting part 230 is greater than the width b2 from the center line L2 to the other side of the connecting part 230.

The difference in widths on either side of the connecting part 230 plays a great role in making the contact pressure of the two terminals 210, 220 similar or identical. In particular, as shown in FIG. 5, it is preferable that the side portion of the connecting part 230 that is narrow in width measured from the center line L of the elasticity reinforcement hole 231 is formed at the rear of the auxiliary terminal 220, which is the longer and wider of the two terminals 210, 220, and the portion that is wider as measured from the center line L of the elasticity reinforcement hole 231 is formed behind the main terminal 210, which is the shorter and narrower of the two terminals 210, 220, because plastic deformation of the terminals 210, 220 is thereby reduced.

In other words, plastic deformation of the terminals may be effectively prevented by means of a structure that has a trapezoidal shape with an elasticity reinforcement hole 231 formed on a connecting part 230, and wherein the widths of the part of the connecting part 230 located to a given side of the elasticity reinforcement hole 231 are proportionally opposite to the widths of the two terminals 210, 220.

The main terminal 210 is also formed with narrowing left-right width from the point at which it bifurcates from the connecting part 230 to the part where the second contact point 223 is formed, enabling straightforward elastic deformation. To this end, the side located toward the auxiliary terminal 220 is formed at an incline.

Figure 7:
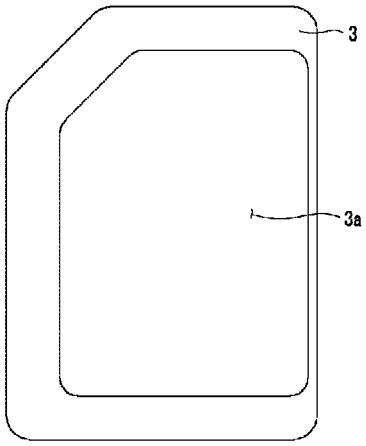
FIG. 7 is a top view of the card adapter.

FIG. 7 is a top view of the card adapter; FIGS. 8 through 11 are oblique views showing the process of removing a card adapter previously inserted in a socket wherein is furnished a access terminal according to Embodiment 1 of this disclosure from the socket.

SIM cards are manufactured and used in diverse sizes, including mini SIM cards, micro SIM cards, and nano SIM cards. Because these cards differ in size, the sizes of the corresponding sockets must also vary accordingly. If respectively different sockets are thus furnished for each card, this becomes a factor increasing the unit cost of the product, so card adapters 3 have been developed and implemented that enable both large and small SIM cards to be used. Specifically, a large SIM card is simply used as-is without an adapter, while a small SIM card is coupled to the card adapter for use.

When mobile telephony terminals are shipped, typically they are shipped with a card adapter coupled to the card socket. In addition, sometimes a SIM card is not coupled to the SIM card adapter when in use, and only the card adapter is coupled to the card socket.

As shown in FIG. 7, on the card adapter 3 is furnished a card coupling hole 3*a* for the SIM card to be inserted and coupled; because the access terminal is formed inclined in the direction of insertion, when the card adapter 3 is inserted into the card socket, the card adapter 3 can be smoothly inserted without being obstructed by the access terminal. However, if the card adapter 3 is removed from the card socket, the card coupling hole 3*a* of the card adapter 3 will catch on the end of the access terminal and prevent easy separation, and in addition, the access terminal may be deformed and damaged by excessive force being applied during removal. This disclosure is able to resolve these problems by furnishing an auxiliary terminal 220.

Figure 8:
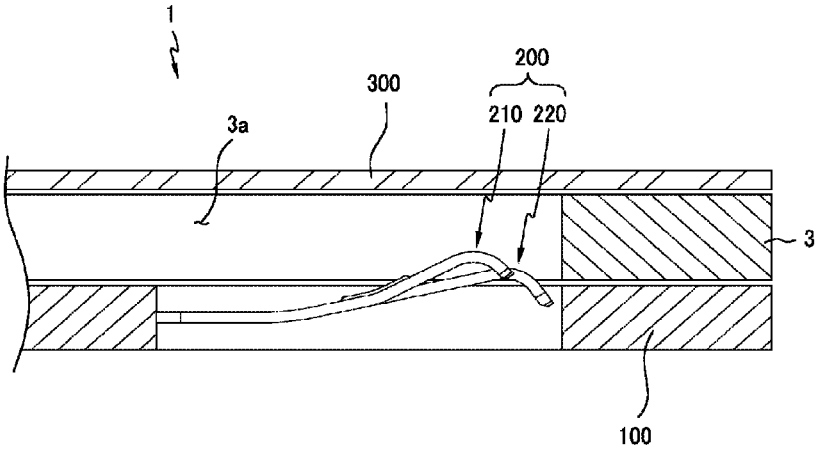
FIGS. 8 through 11 are oblique views showing the process of removing a card adapter previously inserted in a socket wherein is furnished a access terminal according to Embodiment 1 of this disclosure from the socket.

As seen in FIG. 8, according to this disclosure, when the access terminal 200 is mounted on the housing 100, the front end of the main terminal 210 is located on the internal floor of the housing 100, and the front end of the auxiliary terminal 220 is located below the internal floor of the housing 100.

When the card adapter 3 is coupled to the card socket 1, the edge of the card coupling hole 3*a* is not contacted with the front end of the access terminal 200. Even when it does make contact, it does not make contact with the main terminal 210, but contacts the top surface of the front end part of the auxiliary terminal 220.

Figure 9:
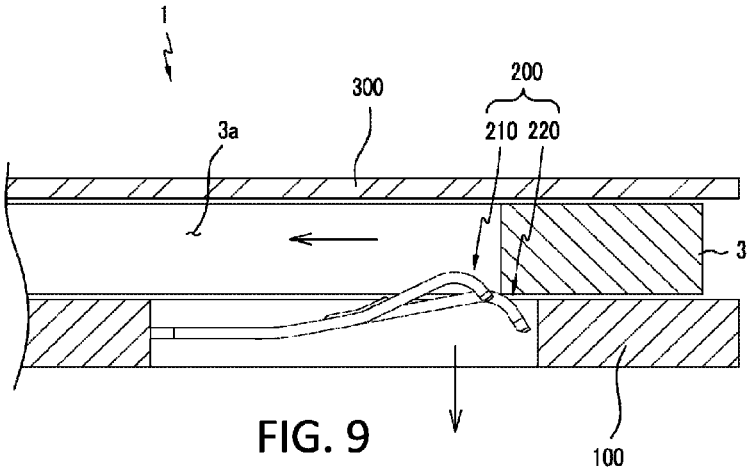

As shown in FIG. 9, if the card adapter 3 is pulled in order to remove it, the edge of the card coupling hole 3*a* first contacts the top surface of the front end of the auxiliary terminal 220 as the auxiliary terminal 220 is pushed downward. If the auxiliary terminal 220 is thus pushed downward, the main terminal 210, which is connected as a single unit with the auxiliary terminal 220, also descends, and the front end thereof descends below the floor of the internal surface of the housing 100. Accordingly, the edge of the card coupling hole 3*a* does not catch on the front end of the main terminal 210.

Figure 10:
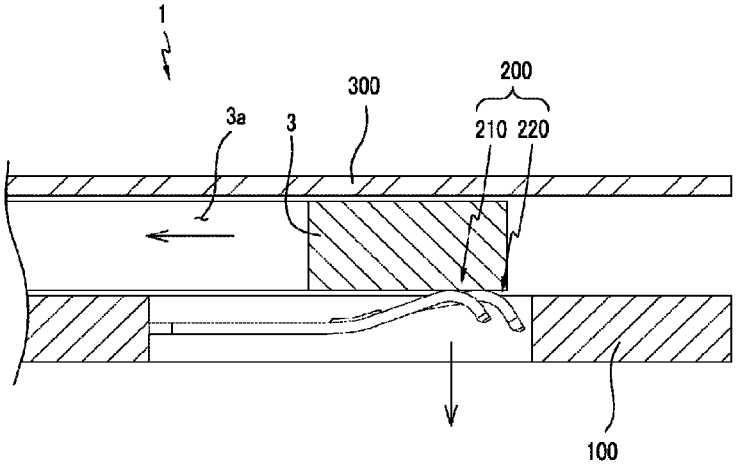

As shown in FIG. 10, if the card adapter 3 continues to be pulled, the area around the card coupling hole 3*a* presses against both the auxiliary terminal 220 and the main terminal 210, thus facilitating separation from the card socket 1.

Figure 11:
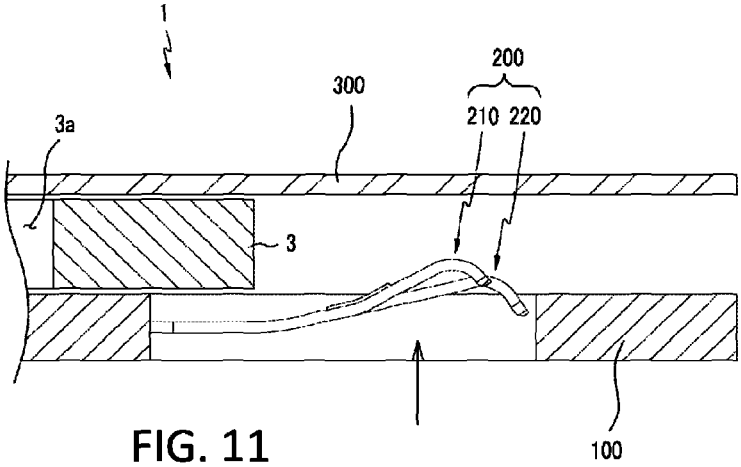

As shown in FIG. 11, if the card adapter 3 passes the access terminal 200 as it is being removed, the access terminal 200, comprising the main terminal 210 and auxiliary terminal 220, is restored to its original state by its own elasticity.

In one embodiment of this disclosure, the front ends of the main terminal 210 and auxiliary terminal 220 are located on the housing 100 pointing toward the rear, and there is consequently a risk of catching when the card adapter 3 is inserted; to address this, the auxiliary terminal 220 is formed so as to induce the main terminal 210 to descend. This role of the auxiliary terminal 220 may be applied in the same way even when the front ends of the main terminal 210 and auxiliary terminal 220 are facing the front of the housing 100. In other words, the auxiliary terminal 220 may induce the main terminal 210, to which it is connected via the connecting part 230, to descend as the auxiliary terminal descends upon first contacting the card or card adapter 3 when the card or card adapter 3 is inserted or removed.

Figure 14:
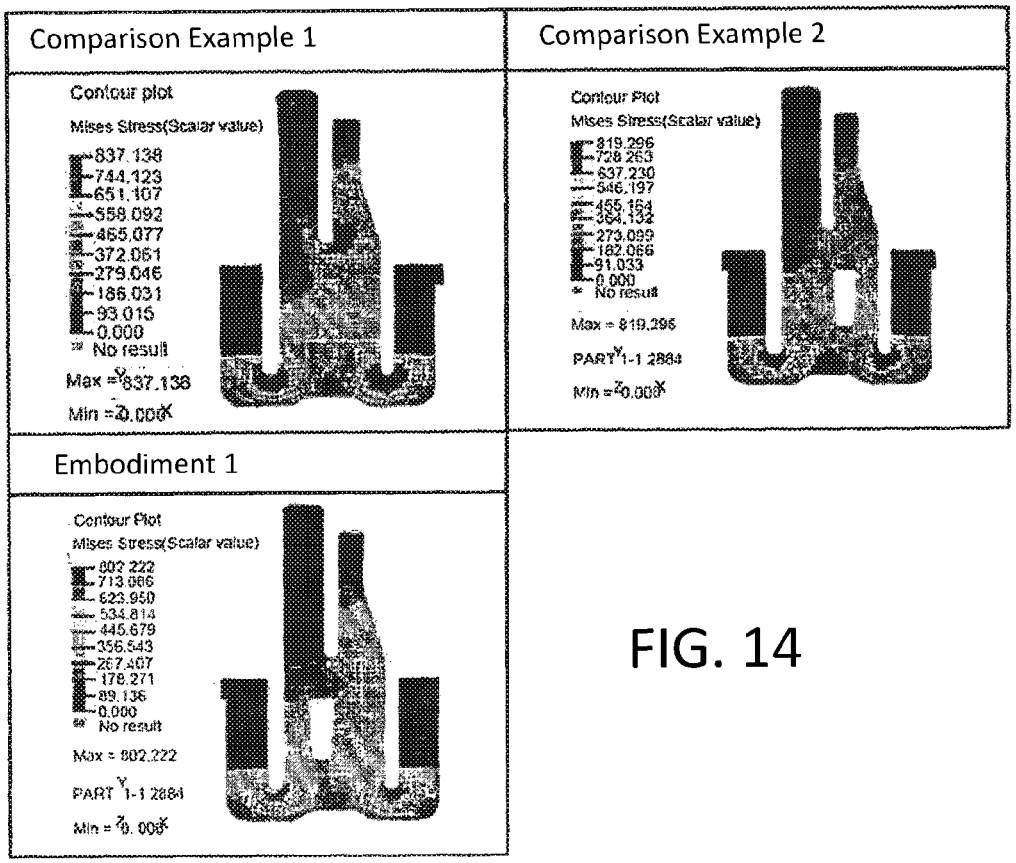
FIG. 14 illustrates stress results exhibited by respective terminals in diverse shapes (Comparison Example 1, Comparison Example 2, Embodiment 1), having two terminals with different widths and lengths and a connecting part connecting the two terminals, which are subjected to forces of identical magnitudes.

Hereinbelow, the stresses exhibited by respective terminals in diverse shapes (Comparison Example 1, Comparison Example 2, Embodiment 1), having two terminals with different widths and lengths and a connecting part connecting the two terminals, are subjected to forces of identical magnitudes. The stress results are shown in FIG. 14.

Comparison Example 1 is a terminal for use in a socket wherein the lengths and widths of the main and auxiliary terminals differ, and no elasticity reinforcement hole is formed on the connecting part; Comparison Example 2 is a terminal for use in a socket wherein the lengths and widths of the main and auxiliary terminals differ and an elasticity reinforcement hole is formed on the connecting part. The elasticity reinforcement hole in Comparison Example 2 is shown in the drawings as offset to the right (behind the main terminal). Embodiment 1 is a terminal for a socket according to Embodiment 1 of this disclosure; the lengths and widths of the main and auxiliary terminals differ, and the elasticity reinforcement hole formed on the connecting part is offset to the left (behind the auxiliary terminal) in the drawings.

Examining the trend in stress when the contact terminals are subjected to forces of identical magnitudes, the stresses are 837.138 MPa in Comparison Example 1 where there is no elasticity reinforcement hole, 819.296 MPa in Comparison Example 2 where the elasticity reinforcement hole is furnished but is offset toward the rear of the main terminal, and 802.222 MPa in Embodiment 1 where the elasticity reinforcement hole is offset toward the rear of the auxiliary terminal.

Reviewing these results, Comparison Example 2 and Embodiment 1, which have an elasticity reinforcement hole, may be used as access terminals for sockets; of these, when Embodiment 1 is used, it increases the reliability of the contact and the lifespan of the terminal, so that it is the most preferable.

Figure 12:
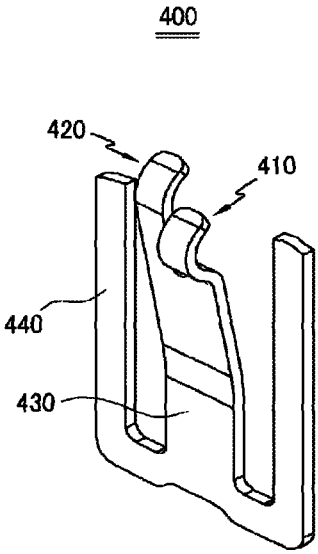
FIG. 12 is an oblique view of the card socket access terminal according to Embodiment 2 of this disclosure.
Figure 13:
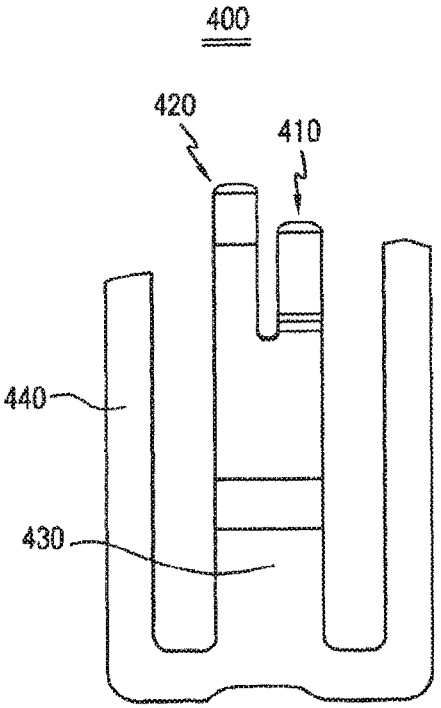
FIG. 13 is a top view of FIG. 12.

FIG. 12 is an oblique view of the card socket access terminal according to Embodiment 2 of this disclosure; FIG. 13 is a top view of FIG. 12.

The access terminal 400 according to this embodiment comprises: a main terminal 410, an auxiliary terminal 420, a connecting part 430, and an embedding part 440.

In contrast to Embodiment 1, the card socket access terminal 400 according to this embodiment has a shape wherein the width of the main terminal 410 remains constant toward the front end. The auxiliary terminal 420 likewise, as in Embodiment 1, maintains a constant width toward the front end.

In this embodiment, a separate elasticity reinforcement hole is not formed on the connecting part 430; the embedding part 440 is the same as the embedding part 240 of Embodiment 1.

Hereinabove, a description has been given of the card socket access terminal of this disclosure, based on preferred embodiments; however, this disclosure is not limited to specific embodiments, and a person having ordinary skill in the art of the relevant field can modify these embodiments in various ways without departing from the scope disclosed in the claims.

For example, in the presented embodiment of this disclosure, the main terminals and auxiliary terminals are furnished one-to-one, but the disclosure is not limited thereto, and an auxiliary terminal could be furnished on either side of the main terminal. Further, the front end of the auxiliary terminals could also be connected if an auxiliary terminal were furnished on either side of the main terminal.

The invention claimed is:

1. An access terminal for a card socket of an electronic device, the access terminal being furnished on a housing of the card socket so as to make contact with a card that holds various data for information, the access terminal comprising:

a main terminal that is configured to make contact with a card terminal furnished on the card;

an auxiliary terminal that is configured to optionally make contact with the card terminal; and a connecting part that connects the main terminal and the auxiliary terminal, wherein the connecting part has an elasticity reinforcement hole formed therethrough to facilitate elastic deformation of the main and auxiliary terminals without plastic deformation.

2. The access terminal according to claim 1, wherein the main terminal and the auxiliary terminal have different widths.

3. The access terminal according to claim 1, wherein the connecting part has a left edge and a right edge, wherein the elasticity reinforcement hole is formed proximate to one of the left and right edges and distal to the other one of the left and right edges, wherein the elasticity reinforcement hole defines a center line which passes therethrough from front to back, and wherein a distance to the proximate edge of the connecting part to the center line is less than a distance from the center line to the distal edge of the connecting part.

4. The access terminal according to claim 3, wherein portions of the connecting part defined between the elasticity reinforcement hole and the left and right edges become narrower in width toward a front of the connecting part.

5. The access terminal according to claim 1, wherein the elasticity reinforcement hole becomes wider toward a front of the connecting part.

6. The access terminal according to claim 3, wherein the main terminal is longer than the auxiliary terminal, and wherein a first portion of the connecting part is defined between the elasticity reinforcement hole and the left edge of the connecting part and a second portion of the connecting part is defined between the elasticity reinforcement hole and the right edge of the connecting part, wherein the first portion of the connecting part has a lesser width than the second portion of the connecting part, wherein the first portion of the connecting part is located behind the main terminal.

7. The access terminal according to claim 6, wherein a width of the auxiliary terminal is less than a width of the main terminal.

8. The access terminal according to claim 3, wherein the auxiliary terminal is longer than the main terminal, and wherein a first portion of the connecting part is defined between the elasticity reinforcement hole and the left edge of the connecting part and a second portion of the connecting part is defined between the elasticity reinforcement hole and the right edge of the connecting part, wherein the first portion of the connecting part has a lesser width than the second portion of the connecting part, wherein the first portion of the connecting part is located behind the auxiliary terminal.

9. The access terminal according to claim 8, wherein a width of the main terminal is less than a width of the auxiliary terminal.

10. An access terminal for a card socket of an electronic device, the access terminal being furnished on a housing of the card socket so as to make contact with a card that holds various data for information, the access terminal comprising:

a main terminal that is configured to make contact with a card terminal furnished on the card;

an auxiliary terminal that is configured to optionally make contact with the card terminal; and a connecting part that connects the main terminal and the auxiliary terminal, wherein when the card is removed from, or inserted into, the housing of the card socket, the auxiliary terminal is configured to first contact the card and descend, and, as the auxiliary terminal is connected to the main terminal via the connecting part, the descent of the auxiliary terminal induces the main terminal to descend.

11. The access terminal according to claim 10, wherein the main terminal and auxiliary terminal each comprise:

an upward-inclined part that is extended from the connecting part and is formed inclined upward obliquely toward a front end thereof so that the upward-inclined part has internal elasticity; and a downward-inclined part that inclines downward obliquely from the front end of the upward-inclined part.

12. The access terminal according to claim 10, wherein the main and the auxiliary terminal have different widths and different contact point heights.

13. The access terminal according to claim 12, wherein the contact point of the main terminal and the contact point of the auxiliary terminal are formed with different back-and-forth positions.

14. The access terminal according to claim 10, wherein the auxiliary terminal is formed longer than the main terminal, and a front end of the auxiliary terminal is positioned lower than a front end of the main terminal on the housing.

15. The access terminal according to claim 10, wherein when the access terminal is mounted in the housing, a front end of the auxiliary terminal is located lower than an internal floor of the housing.

16. The access terminal according to claim 10, wherein the main terminal and access terminal are formed bifurcating from a front end of the connecting part.

17. The access terminal according to claim 11, wherein the upward-inclined part of the main terminal is formed with a shape that narrows to left and right.

* * * * *